US008526633B2

(12) United States Patent
Ukai et al.

(10) Patent No.: US 8,526,633 B2
(45) Date of Patent: Sep. 3, 2013

(54) ACOUSTIC APPARATUS

(75) Inventors: Satoshi Ukai, Hamamatsu (JP); Ryo Tanaka, Hamamatsu (JP); Toshiaki Ishibashi, Fukuroi (JP)

(73) Assignee: Yamaha Corporation (JP)

( * ) Notice: Subject to any disclaimer, the term of this patent is extended or adjusted under 35 U.S.C. 154(b) by 760 days.

(21) Appl. No.: 12/663,220

(22) PCT Filed: May 28, 2008

(86) PCT No.: PCT/JP2008/059814

§ 371 (c)(1),
(2), (4) Date: Dec. 4, 2009

(87) PCT Pub. No.: WO2008/149747

PCT Pub. Date: Dec. 11, 2008

(65) Prior Publication Data

US 2010/0166195 A1 Jul. 1, 2010

(30) Foreign Application Priority Data

Jun. 4, 2007 (JP) ..... 2007-147997

(51) Int. Cl.
*H04R 3/00* (2006.01)

(52) U.S. Cl.
USPC ..... 381/92; 381/122; 381/26; 381/356

(58) Field of Classification Search
USPC ..... 381/91, 92, 122, 26, 355, 356, 358, 381/66
See application file for complete search history.

(56) References Cited

U.S. PATENT DOCUMENTS

| | | | | |
|---|---|---|---|---|
| 3,573,400 | A * | 4/1971 | Sessler et al. | 381/357 |
| 3,979,712 | A * | 9/1976 | Ettenhofer et al. | 367/125 |
| 4,393,270 | A * | 7/1983 | van den Berg | 381/98 |
| 4,559,642 | A * | 12/1985 | Miyaji et al. | 381/92 |
| 5,524,059 | A * | 6/1996 | Zurcher | 381/92 |
| 5,778,083 | A * | 7/1998 | Godfrey | 381/92 |
| 5,862,240 | A * | 1/1999 | Ohkubo et al. | 381/356 |

(Continued)

FOREIGN PATENT DOCUMENTS

| | | |
|---|---|---|
| JP | 61-056600 A | 3/1986 |
| JP | 63-144699 A | 6/1988 |

(Continued)

OTHER PUBLICATIONS

International Search Report issued in corresponding PCT/JP2008/059814, dated Jul. 8, 2008.

(Continued)

*Primary Examiner* — Xu Mei
(74) *Attorney, Agent, or Firm* — Rossi, Kimms & McDowell LLP

(57) ABSTRACT

An acoustic apparatus without increasing noise etc. even when plural directional microphones collect sounds from a place of the same distances is provided. Sound signals output from the microphone arrays are subjected to phase shift by phase shift circuits 211A to 211H, and the sound signals are combined by an adder 212. The phase shift circuits 211A to 211H performs phase shifts according to installation positions of the microphone arrays. The phase shift circuit 211A makes the shift 0 degree, the phase shift circuit 211B makes the shift 45 degrees, the phase shift circuit 211C makes the shift 90 degrees, and sequentially to the phase shift circuit 211H, the shifts are made according to rotational angles.

4 Claims, 5 Drawing Sheets

(56) References Cited

U.S. PATENT DOCUMENTS

| | | | | |
|---|---|---|---|---|
| 6,069,961 | A * | 5/2000 | Nakazawa | 381/92 |
| 7,035,415 | B2 * | 4/2006 | Belt et al. | 381/92 |
| 7,366,308 | B1 * | 4/2008 | Kock | 381/92 |
| 7,366,310 | B2 * | 4/2008 | Stinson et al. | 381/92 |
| 2003/0059061 | A1 | 3/2003 | Tsuji et al. | |
| 2005/0207591 | A1 | 9/2005 | Tsuji et al. | |
| 2005/0225497 | A1 | 10/2005 | Christensen et al. | |

FOREIGN PATENT DOCUMENTS

| | | | |
|---|---|---|---|
| JP | 04-178100 | A | 6/1992 |
| JP | 8-204803 | A | 8/1996 |
| JP | 2000-184051 | A | 6/2000 |
| JP | 2003-87887 | A | 3/2003 |
| JP | 2003-250192 | A | 9/2003 |
| JP | 2005-521283 | A | 7/2005 |
| JP | 2005-333270 | A | 12/2005 |
| JP | 2006-333062 | A | 12/2006 |
| JP | 2007-5969 | A | 1/2007 |

OTHER PUBLICATIONS

Office Action issued Feb. 6, 2012 for corresponding JP2007-147997.
Japanese Office Action issued in Japanese counterpart application No. JP2007-147997, dated Nov. 13, 2012. English translation provided.

* cited by examiner

ACOUSTIC APPARATUS

This application is a U.S. National Phase Application of PCT International Application PCT/2008/059814 filed on 28 May 2008, which is based on and claims priority from JP 2007-147997 filed on 4 Jun. 2007, the contents of which are incorporated herein by reference in their entirety.

TECHNICAL FIELD

This invention relates to an acoustic apparatus for collecting a sound mainly, and particularly to an acoustic apparatus having plural directional microphones.

BACKGROUND ART

In recent years, an audio conference apparatus provided with a speaker and a microphone integrally in order to conduct audio conference (communication conference) becomes widespread. The audio conference apparatus sends a sound collected by a microphone to a connection destination and emits a sound received from the connection destination by the speaker. In the case of conducting conference by plural persons, such an audio conference apparatus is often installed in the center (for example, the center of a conference desk) of conference participants. Therefore, it is desirable to miniaturize such an audio conference apparatus and, for example, as shown in Patent Reference 1, an audio conference apparatus miniaturized by omitting a case for speaker is proposed.

Also, an apparatus in which plural directional microphones are installed so as to be directed to the periphery around the apparatus is provided in consideration that the apparatus is placed in the center of a conference desk.

Patent Reference 1: JP-A-8-204803

DISCLOSURE OF THE INVENTION

Problems that the Invention is to Solve

However, in a configuration of Patent Reference 1, the configuration is a compact configuration, but a speaker is near to a microphone, therefore diffraction sound volume becomes large.

On the other hand, in the apparatus in which the plural directional microphones are mounted so as to be directed to the periphery around the apparatus, sounds emitted at positions (or regions near to the positions) of the same distance from all the directional microphones are collected in the same phase, therefore there is a problem that a sound collected from a particular region becomes a very large level. As a result of this, for example, noise etc, generated from an air-conditioning equipment installed in a ceiling are collected at a particularly large level and are harsh on the ear.

Hence, an object of the invention is to provide an acoustic apparatus without increasing noise etc, even when plural directional microphones collect sounds from positions located at the same distance.

Means for Solving the Problems

In this invention, there is provided an acoustic apparatus, comprising:

a plurality of sound collection sections arranged on a circumference around one axis, wherein sound collection directions of the sound collection sections are set toward normal directions of the circumference in a plane orthogonal to the axis; and a sound signal processing section that delays a phase of a sound signal output from each of the sound collection sections by an angle on the circumference at an installation position of each of the sound collection sections and combines the sound signals.

In this configuration, the plurality of sound collection sections are respectively provided on the circumference around the axis. The sound collection sections are provided toward normal directions (for example, when a case has a disk shape, the normal directions are directions toward a case side face) of the circumference in the plane orthogonal to the axis. Sound signals output from the sound collection sections are subjected to the phase shifts according to the installation position (an angle on the circumference) of each of the sound collection sections. For example, when an installation position is positioned at 180 degrees, a phase is also shifted 180 degrees. Sounds emitted at positions (axis direction) extending toward an upper face and a lower face from a center position of a case are collected with substantially the same level by all the sound collection sections, but are combined after phase shifts. As a result, the sounds are canceled. On the other hand, sounds emitted from a side face are collected with a high level by the sound collection section nearest to its position, so that the sounds are not canceled after combination.

Also, in this invention, each of the sound collection sections includes a microphone array in which a plurality of microphone units are arranged, and a delay processing portion which delays and combines sound signals collected by the microphone units to provide directivity for the sound collection section.

The sound collection section has a microphone array in which the microphone units are arranged, and a delay processing portion. The directivity great in a predetermined direction is set by delaying and combining the sound signals collected by the microphone units.

Also, in this invention, the acoustic apparatus further includes a speaker in which a sound emission direction is set in an extending direction of the axis.

In this configuration, the speaker is provided so that a sound emission face of the speaker is directed in an extending direction of the axis from the center position of the case. The extending direction of the axis includes an upper face direction, a lower face direction of the case or both the directions. A sound may be emitted toward the upper face direction or the lower face direction of the case. Also, a sound may be emitted toward both the directions. Even when sounds are collected by the sound collection sections, the sounds emitted in the sound emission directions are canceled, so that occurrence of echo can be suppressed.

Also, in this invention, the acoustic apparatus further includes an adaptive echo canceller that subtracts a pseudo feedback signal in which a sound signal input to the speaker is filtered from an output signal of the sound signal processing section to output a signal.

In this configuration, an echo component is eliminated by estimating a diffraction component emitting from the speaker to the sound collection section and subtracting the estimated diffraction component from the output signal of the sound signal processing section.

Advantage of the Invention

According to the invention, even in the case of collecting sounds emitted in a position away from the directional microphones (sound collection sections) by the same distances, the sounds are canceled by being combined after phase shifts are performed, so that noise etc. occurring in the position are not collected with a high level.

DESCRIPTION OF REFERENCE NUMERALS AND SIGNS

1 AUDIO CONFERENCE APPARATUS
10A~10H MICROPHONE ARRAY
13 SPEAKER
21 MICROPHONE SIGNAL PROCESSING CIRCUIT
22 ECHO CANCELLER
23 INPUT-OUTPUT I/F

BEST MODE FOR CARRYING OUT THE INVENTION

Figure 1:
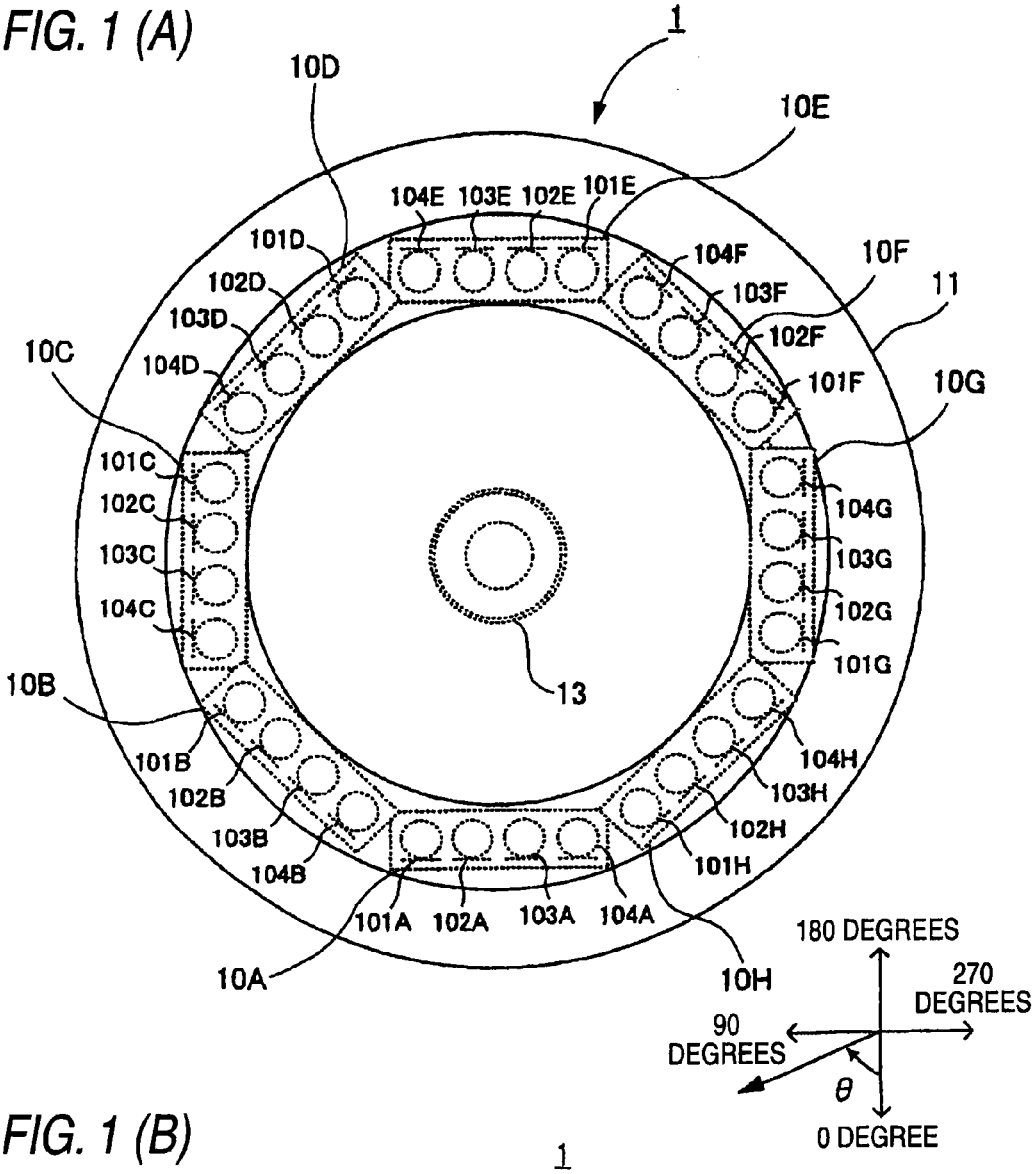
FIG. 1 is a diagram showing an external appearance of an audio conference apparatus.
Figure 1:
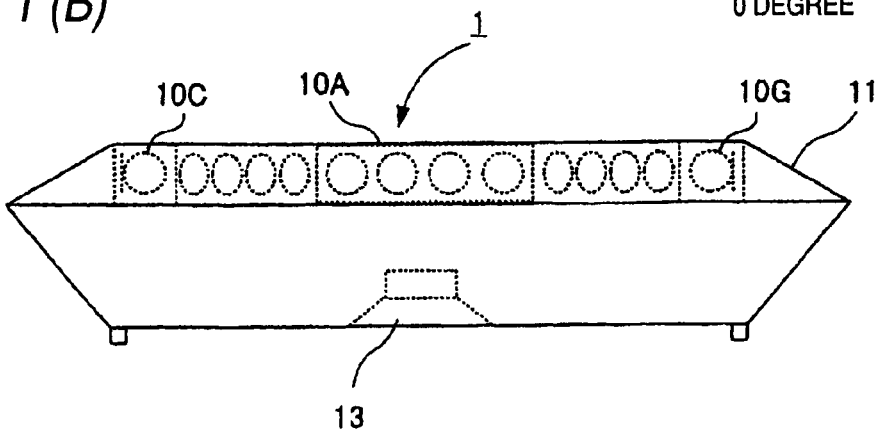

An audio conference apparatus will be described as an embodiment of an acoustic apparatus of the invention, FIG. 1 is an external appearance diagram of the audio conference apparatus according to this embodiment, and FIG. 1(A) is a plan diagram, and FIG. 1(B) is a side diagram. In FIG. 1(A), using a center position in the case of viewing an audio conference apparatus 1 from an upper side as the center of rotation, the paper surface lower side (a sound collection direction of a microphone array 10A) is set at 0 degree and an angle increasing clockwise is set at θ.

The audio conference apparatus 1 includes a disk-shaped case 11. In the case 11, a shape viewed from an upper side is a circular shape with a diameter of about 30 cm. Areas of an upper face and a lower face of the case 11 become narrower than an area of the halfway portion of a vertical direction. In the case 11, a shape viewed from the side of a side face of the case 11 becomes narrow from a predetermined position of a height direction toward the upper face and also becomes narrow toward the lower face. That is, the case 11 includes a shape having respectively inclined faces from the predetermined position to an upper side and an lower side of the case 11.

The eight microphone arrays 10A to 10H are respectively installed inside the upper face side of the case 11 toward a side face of the case 11. Each of the microphone arrays 10A to 10H is placed at an equiangular pitch (an interval of about 45 degrees in this case) using a center position of the case 11 as the center of rotation in the case of being viewed from the upper side. In this case, the sound collection direction of the microphone array 10A is set in a direction of θ=0 degree and each of the microphone arrays 10A to 10H is placed along a direction in which θ increases sequentially by 45 degrees.

The microphone arrays 10A to 10H respectively have plural (four in FIG. 1(A)) microphone units. For example, the microphone array 10A has four microphone units 101A to 104A. Sounds collected by these microphone units 101A to 104A are combined (see FIG. 2) after delay processing is performed by a delay processing portion (see FIG. 2). The combined sound has directivity in a particular direction since the sound are combined after the delay processing is performed. The microphone array 10A has directivity in the direction of θ=0 degree, and the direction of θ=0 degree becomes the sound collection direction. In addition, the number of microphone units is not limited to this embodiment, and could be set properly according to specifications. Also, a unidirectional microphone may be used for the apparatus instead of the microphone array.

A speaker 13 is installed so that a sound emission direction of the speaker 13 is directed to the lower face of the case 11. In addition, a configuration (configuration of a sound emission system) of the speaker 13 is not essential portion when the audio conference apparatus is simply used as a sound collection apparatus.

Figure 2:
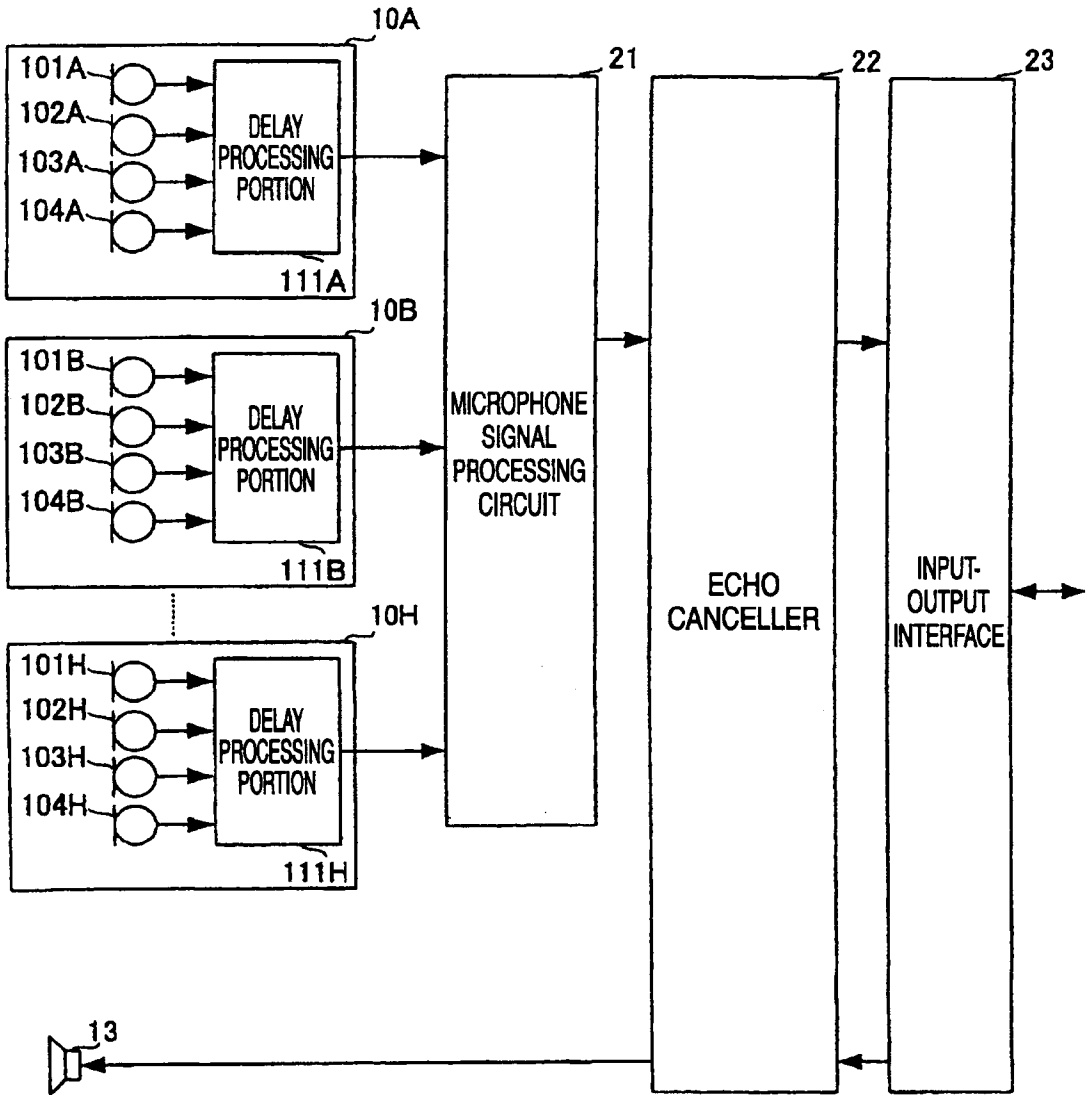
FIG. 2 is a block diagram showing a configuration of the audio conference apparatus.

FIG. 2 is a block diagram showing a configuration of the audio conference apparatus 1. The audio conference apparatus 1 includes a microphone signal processing circuit 21 connected to the microphone arrays 10A to 10H, an echo canceller 22 connected to the microphone signal processing circuit 21, and an input-output I/F 23 connected to the echo canceller 22. In addition, a front-end amplifier for amplifying a sound signal collected by a microphone unit, an A/D converter for making digital conversion of an analog sound signal, a D/A converter for making analog conversion of a digital sound signal and a power amplifier for amplifying a sound signal supplied to a speaker, etc. are omitted in FIG. 2 and unless otherwise specified, a sound signal transferred in the audio conference apparatus 1 shall be a digital sound signal.

The input-output I/F 23 is provided on any face of the case 11, and includes a network connection terminal, a digital audio terminal, and an analog audio terminal (not shown), etc. The audio conference apparatus 1 can be connected to other apparatus by connecting a network cable etc. to the input-output I/F 23.

The microphone arrays 10A to 10H respectively have plural microphone units as described above and delay processing portions for performing delay processing of sound signals collected by each of the microphone units and combining the delayed sound signals and then outputting the sound signals to a subsequent stage. For example, the microphone array 10A has four microphone units 101A to 104A and performs delay and combination processing by the delay processing portion 111A. The signal combined by the delay processing portion of each of the microphone arrays 10A to 10H is input to the microphone signal processing circuit 21.

Figure 3:
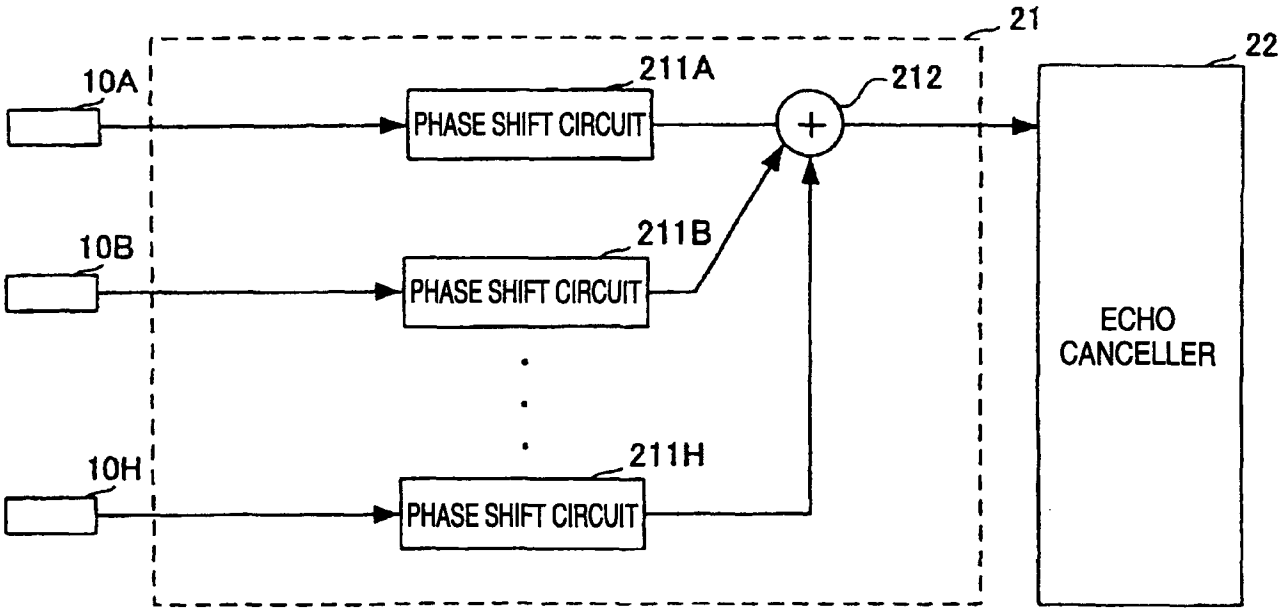
FIG. 3 is a block diagram showing a configuration of a microphone signal processing circuit.

The microphone signal processing circuit 21 performs a phase shift to sound signals output from the microphone arrays 10A to 10H respectively and combines the sound signals to output a combined sound signal to The echo canceller 22 of a subsequent stage. FIG. 3 shows a detailed block diagram of the microphone sign& processing circuit 21. The microphone signal processing circuit 21 includes phase shift circuits 211A to 211H and an adder 212.

The sound signals output from the microphone arrays 10A to 10H are respectively input to the phase shift circuits 211A to 211H. Output signals of the phase shift circuits 211A to 211H are respectively input to the adder 212. The adder 212 combines the output signals of the phase shift circuits 211A to 211H and outputs an output signal to the echo canceller 22 of the subsequent stage.

The echo canceller 22 eliminates an echo component by estimating a diffraction component emitting from the speaker 13 to the microphone arrays 10A to 10H and subtracting the estimated diffraction component from the output signal of the microphone signal processing circuit 21. The echo canceller 22 has an adaptive filter for filtering a signal supplied to the speaker 13, and generates a simulated signal of a diffraction component emitted from the speaker to a microphone by estimates a transfer function of an acoustic transfer system (an acoustic propagation path extending from the speaker to the microphone arrays). The simulated signal is subtracted from the output signal of the microphone signal processing circuit 21. In addition, the transfer function is updated by using a residual signal generated after the echo component is subtracted. A signal in which the echo component is eliminated is input to the input-output I/F 23 and is sent to other apparatus.

In FIG. 3, the phase shift circuits 211A to 211H are constructed of FIR filters etc. and phase shift calculation is performed at the entire frequency band (broad frequency band, for example, several tens of Hz to several kHz) so that a phase of a sound signal is shifted. Here, the phase shift circuits 211A to 211H rotate phases of the signals according to angles corresponding to sound collection directions of the microphone arrays.

The phase shift circuit 211A sets an angle of 0 degree in a sound collection direction of the microphone array 10A as a rotational angle. In other words, the phase shift circuit 211A does not perform a phase shift. The phase shift circuit 211B sets an angle of 45 degrees in a sound collection direction of the microphone array 10B as a rotational angle. In other words, a phase of the signal is delayed 45 degrees. Similarly, the phase shift circuit 2110 delays a phase 90 degrees, and the phase shift circuit 211D delays a phase 135 degrees, and the phase shift circuit 211E delays a phase 180 degrees. Also, the phase shift circuit 211F delays a phase 225 degrees, and the phase shift circuit 211 delays a phase 270 degrees, and the phase shift circuit 211H delays a phase 315 degrees.

Figure 4:
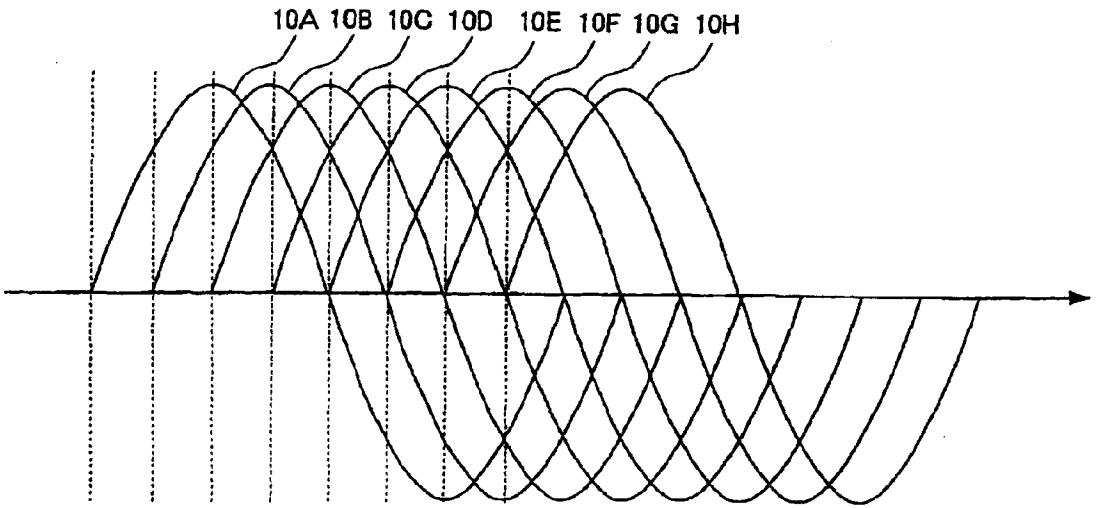
FIG. 4 is a diagram showing a sound signal after a phase shift is performed.
Figure 4:
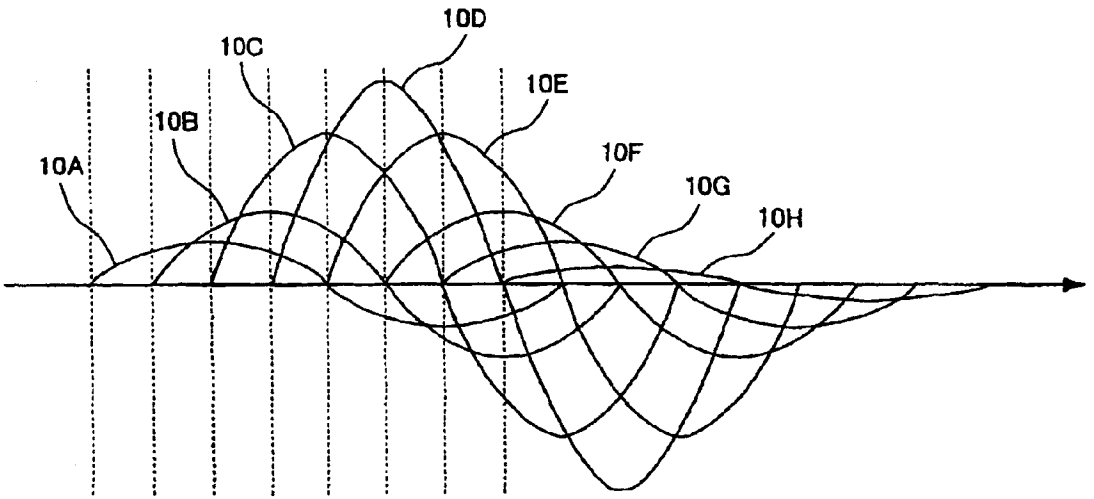

FIG. 4 is a diagram showing signals output from the phase shift circuits 211A to 211H as a result of performs phase shifts to sound signals of the microphone arrays 10A to 10H. FIG. 4(A) shows the case of collecting sounds from a region where distances are equal from all the microphone arrays. The region in which the distances from all the microphone arrays become equal is a region in the vicinity of a center position (central axis) of the audio conference apparatus 1 in the case of viewing the audio conference apparatus 1 from an upper side. For example, as shown in FIG. 5(A), it is the case of collecting a sound emitted from a region 50 positioned at an above area (zenith direction) of the audio conference apparatus 1.

Also, FIG. 4(B) shows the case of collecting sounds emitted from a region near to any one of the microphone arrays. For example, as shown in FIG. 5(B), it is the case of collecting a sound emitted from a region 51 near to the microphone array 10D.

Figure 5:
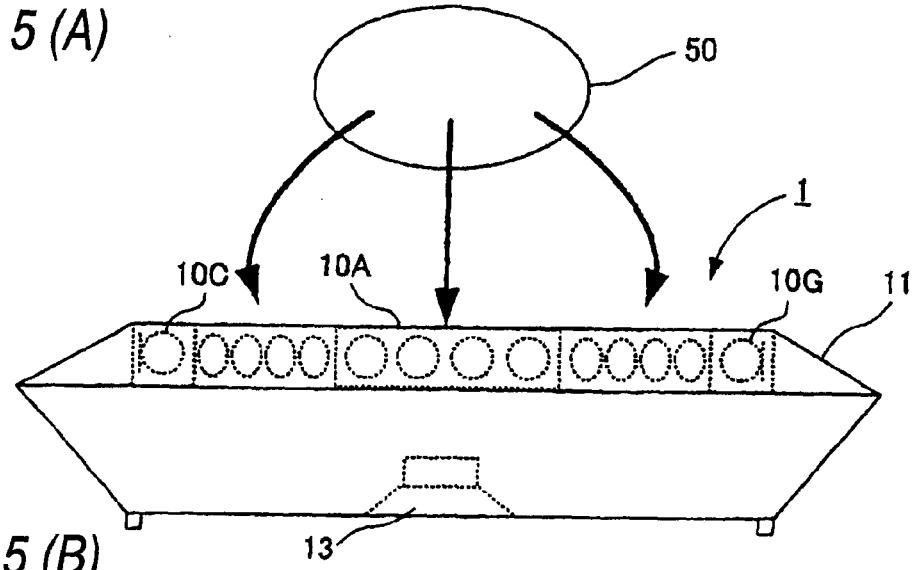
FIG. 5 is a diagram illustrating a situation in which a sound is collected.
Figure 5:
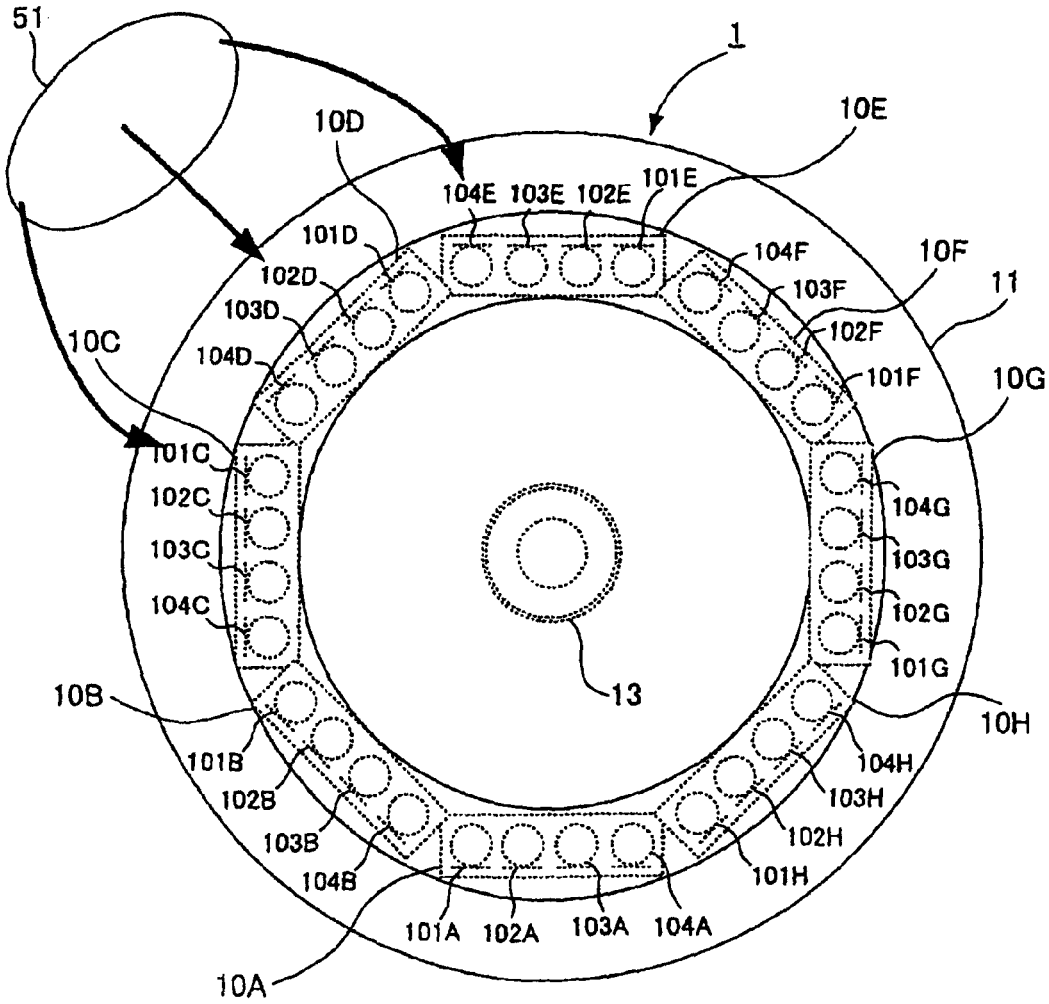

In FIGS. 4(A) and 5(A), all the sounds collected by the microphone arrays 10A to 10H are the same component. Therefore, when the collected sound signals are combined after phase shifts are performed to the collected sound signals by the phase shift circuits 211A to 211H, the sound signals are canceled out For example, a phase of a sound signal collected by the microphone array 10A is shifted 180 degrees with respect to a phase of a sound signal collected by the microphone array 10E, so that the sound signals cancel out mutually.

Thus, the sound signals collected from the region in the vicinity of the central axis of the apparatus by the microphone arrays 10A to 10H are canceled out after combination, so that a level of the sound signal becomes extremely small. As a result of that, for example, a situation in which noise etc. of air-conditioning equipment installed in the ceiling is collected at a high level is eliminated. Also, the speaker 13 is mounted in a center position of the audio conference apparatus 1, so that a situation in which an emitted sound from the speaker 13 is diffracted and is collected with a high level is eliminated. As a result of that, occurrence of howling or echo can be suppressed. Also, a processing load of the echo canceller 22 can be reduced. In addition, a sound emission direction of the speaker 13 may be an upper face direction or a lower face direction. The speaker 13 may emit the sound toward both of the upper face direction and the lower face direction.

On the other hand, in FIGS. 4(B) and 5(B), the sound emitted from the region 51 is collected with a high level by the nearest microphone array 10D, and the microphone arrays collects the sound with a low level as the microphone arrays are distant from the region 51, A sound collected in the most distant microphone array 10H becomes the lowest level. Therefore, a sound signal collected by the microphone array 10D and a sound signal collected by the microphone array 10H do not completely cancel out to each other even when the sound signals are combined. Also, sounds collected by the microphone array 10C and the microphone array 10E are near to a level of the sound collected by the microphone array 10D. However, the sounds collected by the microphone array 10C and the microphone array 10E are not completely canceled out even when the sounds are combined since the phases of the sounds are near (a difference is 45 degrees). Therefore, the sound emitted from the region 51 is collected with the high level.

According to the audio conference apparatus 1 of this embodiment as described above, noise of a zenith direction of the audio conference apparatus 1 is not collected and a sound from a horizontal direction can be collected with a high level, so that a stable sound collection environment can be achieved with respect to all the directions.

Also, filter factors of the phase shift circuits 211A to 211H are not changed dynamically, so that a stable sound collection environment can be achieved.

The invention is based on Japanese patent application (patent application No. 2007-147997) filed on Jun. 4, 2007, and the contents of which are hereby incorporated by reference.

The invention claimed is:

1. An acoustic apparatus comprising:

a plurality of microphone arrays arranged on a circumference around one axis and facing outwardly away the one axis along a plane that is orthogonal to the one axis; and a sound signal processing circuit that delays a phase of a sound signal output from each of the microphone arrays by an angle on the circumference at an installation position of each of the microphone arrays, wherein the sound signal processing circuit includes an adder that combines the sound signals delayed by the sound signal processing circuit, wherein an angle of one microphone array, among the microphone arrays, is set to 0 degrees as a reference angle, the one microphone array being arranged at a reference installation position, wherein the other microphone arrays, among the microphone arrays, are arranged at installation positions along the circumference so that the angles of the installation positions of the other microphone arrays from the reference position are increased along a circumferential direction around the one axis, respectively, and wherein the sound signal processing circuit delays the phase of the sound signal output from each of the other microphone arrays in accordance with the angle of each of the installation positions of the other microphone arrays from the reference installation position.

2. The acoustic apparatus according to claim 1, wherein each of the microphone arrays contains a plurality of microphone units, and a delay processing circuit that delays and combines sound signals collected by the respective microphone units to provide directivity for the respective microphone array.

3. The acoustic apparatus according to claim 1, further comprising a speaker in which a sound emission direction is set along a direction of the axis.

4. The acoustic apparatus according to claim 3, further comprising an adaptive echo canceller that subtracts a pseudo feedback signal in which a sound signal input to the speaker is filtered from an output signal of the sound signal processing circuit to output a signal.

* * * * *